US006527464B2

(12) United States Patent
Lee

(10) Patent No.: US 6,527,464 B2
(45) Date of Patent: Mar. 4, 2003

(54) FINGERTIP PEN/STYLUS

(76) Inventor: Winston Delano Lee, 1428 Springdell Cir., Provo, UT (US) 84604

( * ) Notice: Subject to any disclaimer, the term of this patent is extended or adjusted under 35 U.S.C. 154(b) by 0 days.

(21) Appl. No.: 09/999,428

(22) Filed: Dec. 3, 2001

(65) Prior Publication Data

US 2002/0034412 A1 Mar. 21, 2002

Related U.S. Application Data

(63) Continuation-in-part of application No. 09/759,612, filed on Jan. 13, 2001, now abandoned.

(60) Provisional application No. 60/180,117, filed on Feb. 3, 2000, and provisional application No. 60/176,681, filed on Jan. 18, 2000.

(51) Int. Cl.[7] ..... A46B 5/02

(52) U.S. Cl. ..... 401/8; 401/6; 401/258; 401/37; 401/16; 401/17; 401/21

(58) Field of Search ..... 401/6, 7, 8, 17, 401/18, 20, 37, 213, 48, 2, 258, 21

(56) References Cited

U.S. PATENT DOCUMENTS 5,176,460 A * 1/1993 Garry ..... 401/202
5,564,850 A * 10/1996 Nagaoka ..... 401/37
5,912,662 A 6/1999 Bunn et al.
5,940,066 A 8/1999 Weinblatt
D418,494 S 1/2000 Robb
6,081,259 A 6/2000 Teterwak
6,328,494 B1 * 12/2001 Moxon ..... 401/6

FOREIGN PATENT DOCUMENTS

DE 366683 * 1/1923 ..... 401/17

* cited by examiner

*Primary Examiner*—David J. Walczak
(74) *Attorney, Agent, or Firm*—Marcus G. Theodore

(57) ABSTRACT

A multi-purpose fingertip pen/stylus comprising a flexible shaft having first and second ends made of a bendable material, which retains a twisted shape, said shaft sized of sufficient length to wrap and secure about the fingertip of a writing digit or to be used in a straightened position as a conventional pen; the first end adapted as a stylus tip for use with pressure sensitive computer screens, and the second end adapted as a writing tip to extend sufficiently beyond the fingertip of the writing digit stylus to contact and write on a writing surface.

12 Claims, 2 Drawing Sheets

FINGERTIP PEN/STYLUS

RELATED APPLICATIONS

This application is a continuation-in-part application of U.S. patent application Ser. No. 09/759,612 filing date Jan. 13, 2001 entitled "Fingertip Pen/Stylus", now abandoned and claims the benefit of provisional application No. 60/180,117 filed Feb. 3, 2000 and No. 60/176,681 filed Jan. 18, 2000.

BACKGROUND OF THE INVENTION

1. Field of Invention

The present invention relates to digital pens and styluses. In particular, it relates to a multi-purpose fingertip pen/stylus with interchangeable tips designed to be used straight, or wrapped around the index finger of the writing hand as a writing instrument or computer stylus.

2. Description of Related Art

Various pens and styluses are known. For example, Bishop, U.S. Pat. No. 5,529,415 discloses a fingertip pen writer, which slips over the end of a finger for writing. It does not include adjustment means to fit different sized fingers, and includes a cap to prevent ink from the pen accidentally marking the user. FR 2,492,738 discloses a finger stall which supports a pencil or pen and is worn on the writing finger like a thimble. Garry, U.S. Pat. No. 5,176,460 discloses a pen cap for a writing instrument barrel. Johnson, U.S. Pat. No. 181,179 disclosed a combination pen tip/pencil tip writing instrument. Rall, U.S. Pat. No. 1,683,485 discloses another combination pen tip/pencil tip writing implement. Wiese, U.S. Pat. No. 1,710,130 discloses a pen pencil combination. DE 366,683 discloses "piggyback" writing elements of different colors. Omara, U.S. Pat. No. 5,944,433 discloses a pivotal finger retainer for a writing instrument with two usable ends. Nagaoka, U.S. Pat. No. 5,564,850 discloses a writing stylus with a writing end and a stylus end for use on pressure sensitive electronic handwriting devices. Hazzard, U.S. Pat. No. 5,913,629 discloses a retractable tip writing implement, which exposes an input stylus. Janka, U.S. Pat. No. 523,352 discloses a fountain pen with multiple tips. Stratton, GG 2,027,395 discloses a coiled tip pen writing instrument.

A number of computer input styluses are also known. Robb, U.S. Des. Pat. No. 418,494 discloses an ornamental design for a fingertip positioned stylus to input information into pressure sensitive computer data entry screens. It does not have ink to write on paper or other surfaces. Bunn et at, U.S. Pat. No. 5,912,662 discloses a writing instrument for inputting information on pressure sensitive computer screens. Teterwak, U.S Pat. No. 6,081,259 discloses an electrostatic digitizing panel for inputting data into a computer capable of filtering loads such those created by stylus or fingertip pressure. Weinblaa, U.S. Pat. No. 5,940,066 discloses a finger-mounted computer interface device that generates input signals in response to a pressure-sensitive switch at the writing end when it engages a monitoring screen. These computer input styluses are not suitable for writing on paper and other conventional writing surfaces.

Cited of general interest is Gruenwald, U.S. Pat. No. 2,883,691 disclosing a digital toothbrush Laybourne, U.S. Pat. No. Des. 212,981 disclosing a digital writing instrument, Bedol, U.S. Pat. No. 5,405,206 disclosing a finger mounted writing apparatus, The present invention provides a unique multi-purpose digitally wrapped or straight pen/stylus with interchangeable tips, which can be used as a pen for conventional writing or as a stylus for inputting data into a computer pressure sensitive screen, such as a palm pilot.

SUMMARY OF THE INVENTION

The invention comprises a fingertip combination pen/stylus designed to be used either in a straight elongated position, or wrapped around the index, thumb or writing finger of the writing hand. It is constructed of a flexible shaft made of a bendable material, such as nylon or plastic, which retains its twisted shape. The length of the shaft is selected to insure that it may wrap about the fingertip of a writing digit, if desired. In one preferred embodiment, the shaft is made of a length of flexible hollow plastic tube with a wire placed inside to hold the shape. In its simplest form, the flexible shaft has one end adapted as a stylus or ballpoint pen, and the other end is capped or sealed. Thus constructed, the fingertip pen can be used as a conventional stylus or writing pen, or wrapped around the index finger for use as a digital pen/stylus.

In a more complicated form, the one end is adapted as a stylus, and the other end has a writing tip such as a ballpoint ink or liquid graphite ballpoint pen, or a felt tip pen. The ballpoint and felt tip pen tips have a short barrel to store ink. The writing tips are attached to the shaft by insertion of the short barrel inside the hollow shaft cylinder to secure to the end of the flexible shaft. Wire is then placed inside the remainder of the flexible hollow shaft to allow it to bend and retain its bent shape. A removable pen tip cap may be included with the wig tip embodiments. These caps are structured to removably cover the writing tip to prevent accidental marking of the hand or clothing.

In one preferred embodiment, this pen tip cap may be adapted as an eraser, or a stylus to prevent marking. Alternatively, the pen tip cap may be adapted to change the writing point such as a different color pen tip, a pencil tip, or a felt tip pen marking tip so that the shaft may be used with multipurpose interchangeable tips.

In the preferred embodiment, the shaft and tip are colored or patterned to suit the preference of a user. The embodiment has two writing tips. One of the writing tips is constructed as a liquid graphite ball point pen tip and the second tip is constructed as a ball point pen. In another preferred embodiment, the second tip is constructed as a stylus, with a removable writing tip positioned over the stylus.

In another preferred embodiment a pen cap coupling with two ends is included with one end structured to insert onto the antenna of a cell phone. The other end is adapted to fit over and removable secure the pen tip within the pen cap adapter. This pen cap coupling provides a cell phone user with a stored pen or stylus.

The finger tip pen/stylus is used by positioning the tip of the fingertip pen or stylus beyond the index or writing finger of the writing hand in a manner such that it may be grasped by the other fingers and thumb in a position for the writing tip to write upon a writing surface, or the stylus tip to contact the screen of a touch sensitive computer. If desired, the shaft is then wrapped around the index finger and squeeze tightly to secure the same about the finger. When positioned over the fingertip, the fingertip pen/stylus is secured thereto freeing the other fingers. It also provides a fanciful hand decoration, which can be colored or patterned to suit the preference of a user.

The stylus tip is used by extending it sufficiently beyond the index or pointing finger at an angle to prevent obscuring the screen of a touch sensitive computer. The stylus is then pointed to contact the computer screen in a manner to input desired information into the computer.

With a dual ended fingertip pen and stylus, a cap is usually employed when the stylus is being used and the pen end is wrapped about the finger to prevent ink contact with the user. However, the end of the ballpoint pen tip may be wrapped at an angle and stored against the finger so that it doesn't contact the user.

The present invention thus provides a multi-use fingertip pen/stylus, which is convenient to use as a digital pen for writing, or as a pointing stylus to input data into a touch sensitive computer screen for data processing. It may be used in either the straight position, or wrapped about the digit of the hand. As the device may be stored on the hand, there is no need to spend time looking for a pen or stylus. It also does not interfere with the usage of the hand to accomplish other tasks when worn.

DESCRIPTION OF THE ILLUSTRATED EMBODIMENTS

Figure 1:
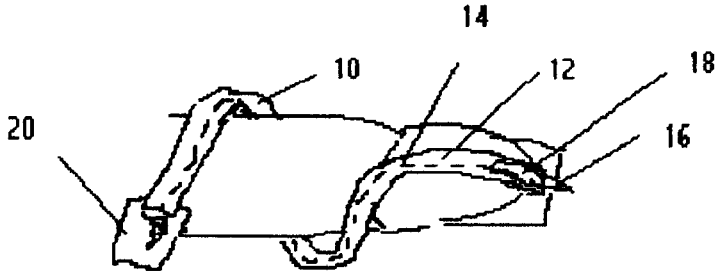
FIG. 1 is a bottom view of the preferred embodiment of applicant's invention.
Figure 2:
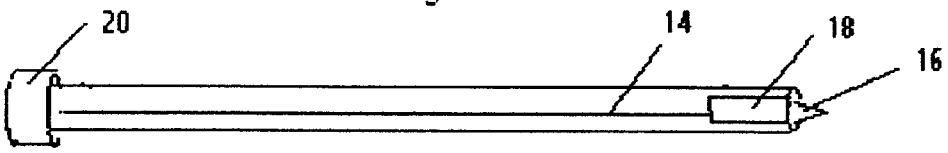
FIG. 2 is a side view of the preferred embodiment shown in FIG. 1.
Figure 3:
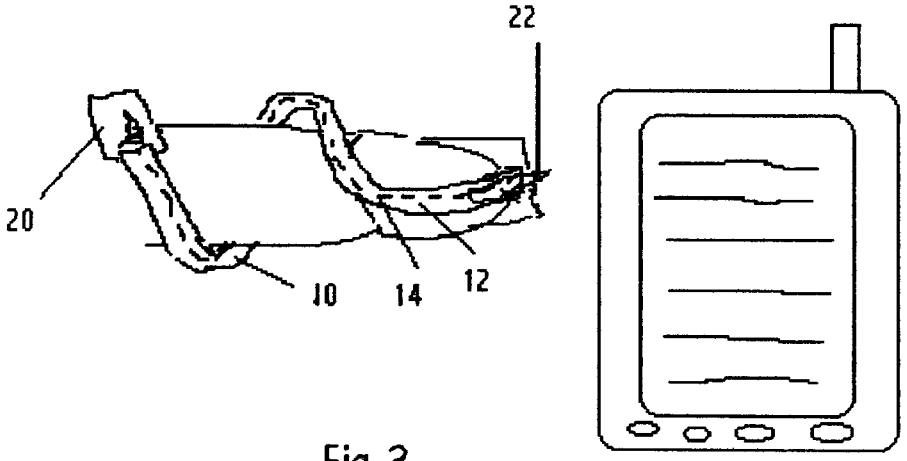
FIG. 3 is a perspective view of the fingertip stylus embodiment.

FIG. 1 is a bottom view of the preferred embodiment of applicant's invention 10 designed to wrap around the index, thumb, or writing finger of a hand as shown in FIGS. 1 and 3. It is constructed of a flexible hollow cylindrical shaft 12 made of plastic. A wire 14 is inserted within the hollow cylindrical shaft 12 to retain a straight shape shown in FIG. 2, or a twisted shape when wound around and attached to a fingertip as shown in FIG. 1. A ballpoint pen tip 16 with an ink barrel 18 is inserted into one end of the hollow shaft 12. The other end of the shaft 12 is capped with an end cap 20, or an erasure 20 shown in FIG. 2. FIG. 2 is a side view of the preferred embodiment shown in FIG. 1 showing how the pen tip 16 can be used in a straight position, depending upon the preference of a user.

FIG. 3 is a perspective view of the fingertip stylus embodiment adapted for use with a pressure sensitive computer screen. A stylus tip 22 is attached to the shaft 12 in a manner sufficient to extend beyond the index or pointing finger as shown to prevent obstruction of the computer screen. This embodiment has a similar capped end with an end cap 20.

Figure 4:
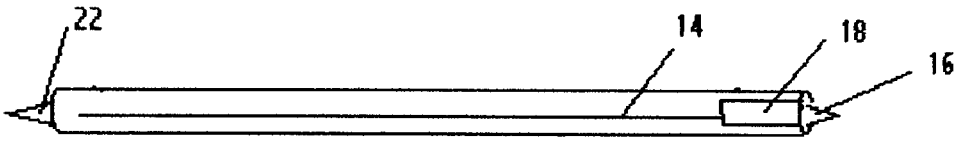
FIG. 4 is a bottom view of another preferred embodiment.

FIG. 4 is a view of another preferred embodiment having a stylus tip 22 and a writing tip 16 attached to both ends of the shaft 12. In this embodiment, either end may be used to provide an instrument which can write, or act as a stylus to input data into a palm pilot type pressure sensitive computer screen. When the stylus 22 is used, the writing tip 16 is positioned in a manner not to contact the finger to cause accidental contact with the user. The dual end embodiment may be colored or patterned to act as a digital ornament for the hand. Advertising may also be included on the shaft 12 or cap 20 to provide an inexpensive marketing giveaway.

Figure 5:
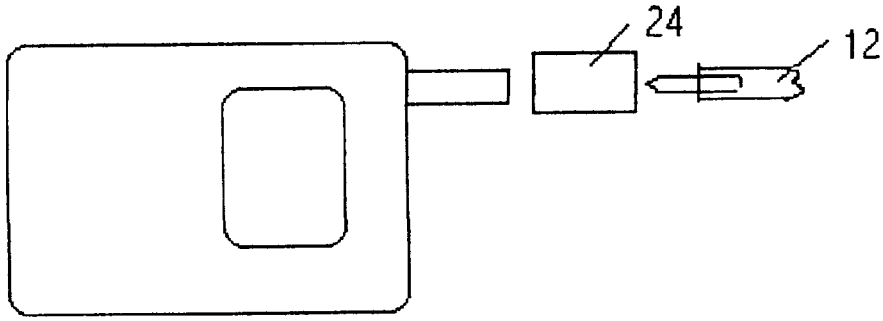
FIG. 5 is a perspective view of a pen cap adapter for a cell phone.

FIG. 5 illustrates an adapter 24 with one end adapted to attach to the antennae of a cell phone, and the other end to secure therein the writing tip 16 or stylus 22 of the fingertip pen/stylus 10.

Figure 6:
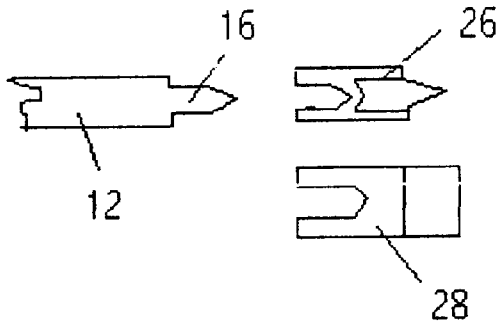
FIG. 6 is a perspective view of a variety of interchangeable tips for the fingertip pen/stylus.

FIG. 6 is a perspective view of a variety of interchangeable tips for the fingertip pen/stylus. A plurality of different types of writing tips 26 and erasers 28 with connecting structure to removably piggy back them onto the end of the writing tip or writing stylus 16 is included. These interchangeable tips 26, 28 provide the fingertip pen/stylus 10 with a variety of writing features to accommodate differing writing styles and colors. By winding the fingertip pen/stylus about the writing finger, it leaves the hand free to perform a variety of tasks, while maintaining a pen or stylus handy for a number of operations.

Although this specification has made reference to the particular embodiments, it is not intended to restrict the scope of the appended claims. The claims themselves recite those features deemed essential to the invention.

I claim:

1. A fingertip pen comprising:

a flexible shaft having first and second ends made of a bendable material, which retains either a straight or a twisted shape according to the preference of a user, said shaft sized of sufficient length to wrap and secure about the fingertip of a writing digit; or to be extended and used in a straightened position to be either gripped by the digits of the hand for writing in an extended gripping mode, or wrapped around a writing digit for writing in an extended single digit mode, and a writing tip attached to the first end structured to extend sufficiently beyond the fingertip of the writing digit to write on a surface.

2. A fingertip pen according to claim 1, including a removable writing tip cap with a cap end structured to cover the writing tip when not in use.

3. A fingertip pen according to claim 1, wherein the shaft and writing tip are colored or patterned to suit the preference of a user.

4. A fingertip pen according to claim 1, wherein the writing tip is a liquid graphite ball point pen.

5. A fingertip pen according to claim 4, wherein the shaft second end includes an eraser.

6. A fingertip pen according to claim 1, including a second writing tip with a removable connection structured to piggy back on and cover the shaft writing tip to provide a different writing tip to suit the preference of a user.

7. A fingertip pen according to claim 6, wherein the second writing tip is a ball point pen having a different color ink, or liquid graphite than that of the shaft writing tip.

8. A fingertip pen according to claim 6, wherein the second writing tip is a felt tip.

9. A fingertip pen according to claim 1, wherein the shaft second end is structured as a pointing stylus to contact a touch sensitive computer screen to input desired information into a computer.

10. A fingertip pen/stylus according to claim 1, including a pen cap coupling with an end structured to insert onto an antenna of a cell phone, the other end structured to fit over the fingertip pen tip and thereby removably secure the fingertip pen tip within the pen cap coupling.

11. A fingertip pen/stylus comprising:

a flexible shaft having first and second ends made of a bendable material, which retains either a straight or a twisted shape according to the preference of a user, said shaft sized of sufficient length to wrap and secure about the fingertip of a writing digit; said shaft structured to be either straightened and extended to be gripped by the digits of the hand for writing in a gripping mode, or wrapped around a writing digit for writing in an extended single digit mode, and a stylus tip attached to the first end structured to extend sufficiently beyond the fingertip of the writing digit stylus to contact a touch sensitive computer screen to input desired information into a computer.

12. A fingertip pen/stylus according to claim 11, including a writing tip with removable connection structure to piggy back on and cover the shaft stylus to provide a writing tip to suit the preference of a user.

* * * * *